US009147549B2

(12) United States Patent
Tracy

(10) Patent No.: US 9,147,549 B2
(45) Date of Patent: Sep. 29, 2015

(54) CROSSED-FIELD AMPLIFIERS WITH ANODE/CATHODE STRUCTURES FOR REDUCED SPURIOUS EMISSIONS

(75) Inventor: Michael L. Tracy, Beverly, MA (US)

(73) Assignee: Communications & Power Industries LLC, Palo Alto, CA (US)

( * ) Notice: Subject to any disclaimer, the term of this patent is extended or adjusted under 35 U.S.C. 154(b) by 283 days.

(21) Appl. No.: 13/424,460

(22) Filed: Mar. 20, 2012

(65) Prior Publication Data

US 2012/0242224 A1 Sep. 27, 2012

Related U.S. Application Data

(60) Provisional application No. 61/466,105, filed on Mar. 22, 2011.

(51) Int. Cl.
*H01J 25/42* (2006.01)
*H01J 23/24* (2006.01)

(52) U.S. Cl.
CPC *H01J 25/42* (2013.01); *H01J 23/24* (2013.01)

(58) Field of Classification Search
CPC ..... H01J 25/42; H01J 25/44; H01J 25/46; H01J 23/24
USPC ..... 333/39.3; 330/47
See application file for complete search history.

(56) References Cited

U.S. PATENT DOCUMENTS

| | | | | |
|---|---|---|---|---|
| 2,939,037 | A | | 5/1960 | Jepsen |
| 3,069,594 | A | | 12/1962 | Feinstein |
| 3,192,435 | A | * | 6/1965 | Feinstein et al. ..... 315/39.3 |
| 3,246,190 | A | * | 4/1966 | Boyd et al. ..... 313/32 |
| 3,330,707 | A | | 7/1967 | Reed |
| 3,614,515 | A | * | 10/1971 | Wilczek ..... 315/3.5 |
| 4,082,979 | A | * | 4/1978 | Farney et al. ..... 315/39.3 |
| 4,413,208 | A | * | 11/1983 | Morizot ..... 315/39.3 |
| 4,719,436 | A | | 1/1988 | Garwin et al. |
| 6,437,510 | B1 | | 8/2002 | Thomas et al. |

* cited by examiner

*Primary Examiner* — Benny Lee
(74) *Attorney, Agent, or Firm* — Nutter McClennen & Fish LLP

(57) ABSTRACT

Various crossed-field amplifiers (CFAs) are disclosed herein. In one embodiment, the geometry of the cathode and/or the anode reduces the velocity of the electrons as they travel near the anode drift block to increase the distribution of the electrons in the drift gap. In another embodiment, an abrupt geometric change to the cathode at the beginning or the end of the anode drift block can disperse the electrons, thereby increasing the rate of mixing and diffusion. By increasing the distribution of the electrons, the peak amplitude of spurious emissions produced by a CFA can be reduced.

9 Claims, 7 Drawing Sheets

--PRIOR ART –

| Cut Depth [%AK] | Worst Case Spur. [dBc] | Ave. Worst Spur. [dBc] | Efficiency |
|---|---|---|---|
| 0.0% | -31 | -40.8 | 56.9% |
| 29.4% | -43.1 | -45.5 | 54.7% |
| 41.2% | -43 | -46.3 | 53.2% |
| 82.4% | -45.2 | -47.4 | 52.2% |

FIG. 6

CROSSED-FIELD AMPLIFIERS WITH ANODE/CATHODE STRUCTURES FOR REDUCED SPURIOUS EMISSIONS

RELATED APPLICATIONS

The present application claims the benefit under §119(e) of U.S. provisional patent application U.S. 61/466,105 filed on Mar. 22, 2011 and entitled "METHOD TO REDUCE SPURIOUS EMISSION IN CROSSED-FIELD AMPLIFIERS."

FIELD OF THE INVENTION

The present invention generally relates to amplifiers, and more specifically, crossed-field amplifiers.

BACKGROUND

Crossed-field Amplifiers (CFAs) are a class of vacuum microwave devices where an applied direct current (DC) electric field is oriented perpendicular to a constant magnetic field. Typically, CFAs have a magnetic field oriented in an axial direction and an electric field applied around a circumference of a cathode. Crossed-field amplifiers are used in many types of radars, in part due to their high efficiency and broad bandwidth.

The most common type of CFA consists of a slow-wave-circuit (SWC) that surrounds a cathode in a cylindrical geometry. These devices generally consist of an input coupler for receiving a radio frequency (RF) input wave, a cathode for emitting electrons, a slow wave circuit, an anode drift block, and an output coupler for transmitting the amplified RF wave. The SWC is usually of the forward wave type in which the electron beam interacts with a wave propagating in the same direction as the electron beam; however, backward wave circuits are also possible, and are referred to as Amplitrons.

In use, the RF wave first enters the SWC through an input coupler. The cathode of the CFA emits electrons as a result of primary (thermionic) or secondary emission, or both. Under the influence of the crossed electric and magnetic fields, the electrons emitted from the cathode rotate around the cathode and form a thin region of high electron density near the cathode surface, known as a hub. When the outer surface of the electric hub has about the same velocity as the RF wave, the rotating electrons give up potential energy to the wave. This causes amplification of the RF wave, also known as gain.

In reentrant beam CFAs, after the bunched electrons pass the output coupler, the SWC ends and the spent bunches drift toward the input coupler without the influence of external RF fields. Ideally, the electron bunches would completely diffuse into a uniform electron stream before reentering the input section of the CFA. But because the spent electrons are in the drift section for a short period of time, there are fluctuations in the electron density upon reentry into the input section. These fluctuations can produce spurious emissions, also referred to as spurious noise. The spurious noise can interfere with radars and a variety of other communication systems.

Accordingly, there is a need for improved cross-field amplifiers with reduced spurious emissions.

SUMMARY OF THE INVENTION

Various crossed-field amplifiers are disclosed herein. In general, a crossed-field amplifier includes an input coupler, an output coupler, a cathode, and an anode. In certain aspects, the input coupler can receive an RF wave and the output coupler can transmit an amplified RF wave. The cathode can have a substantially-cylindrical shape, and the anode can be positioned around an outer circumference of the cathode with a gap therebetween. The anode can be configured to emit electrons to the cathode, and spacing between the anode and the cathode can reduce a velocity of the electrons as the electrons move through a portion of the gap adjacent to an anode drift block.

The CFAs disclosed herein can have a variety of other features. In particular, a CFA can further comprise a body extending around an outer surface of the anode for cooling the amplifier. In another embodiment, the anode can comprise a slow wave circuit and an anode drift block. In yet another embodiment, the slow wave circuit can extend about a range around 270-330 degrees, and the anode drift block can extend about a range around 30 to 90 degrees. Additionally, the spacing between the anode drift block and the cathode can be greater than the spacing between the slow wave circuit and the cathode. More specifically, the radial thickness of the anode drift block can be less than the radial thickness of the slow wave circuit. The magnetic field can also be oriented along a longitudinal axis of the cathode.

In another exemplary embodiment, a crossed-field amplifier can comprise an input coupler, an output coupler, a cathode, and an anode. The input coupler can receive an RF wave and the output coupler can transport an amplified RF wave. The cathode can have a substantially cylindrical shape and the anode can be configured to emit electrons to the cathode. In certain aspects, the anode can comprise an anode drift block that is positioned between the input coupler and the output coupler. A section of the cathode adjacent to the anode drift block can have a reduced-radius such that electrons are dispersed as they move between the cathode and the anode drift block.

In one embodiment, the section of the cathode adjacent to the anode drift block can have a substantially constant radius. In another embodiment, the section of the cathode adjacent to the anode drift block has a first step and a second step that define a first radius of the cathode, and a curved portion that defines a second radius of the cathode. The section of the cathode can extend about a range around about 30-90 degrees. In another embodiment, the anode drift block can extend about a range around 30 to 90 degrees of the CFA. The amplifier can further comprise a body disposed around the anode for cooling. A magnetic field can also be oriented perpendicular to a radius of the cathode.

BRIEF DESCRIPTION OF THE DRAWINGS

The invention will be more fully understood from the following detailed description taken in conjunction with the accompanying drawings, in which:

FIG. 6 is a table of spurious noise and efficiency measurements for various cathode drift radii.

DETAILED DESCRIPTION OF THE INVENTION

Figure 1A:
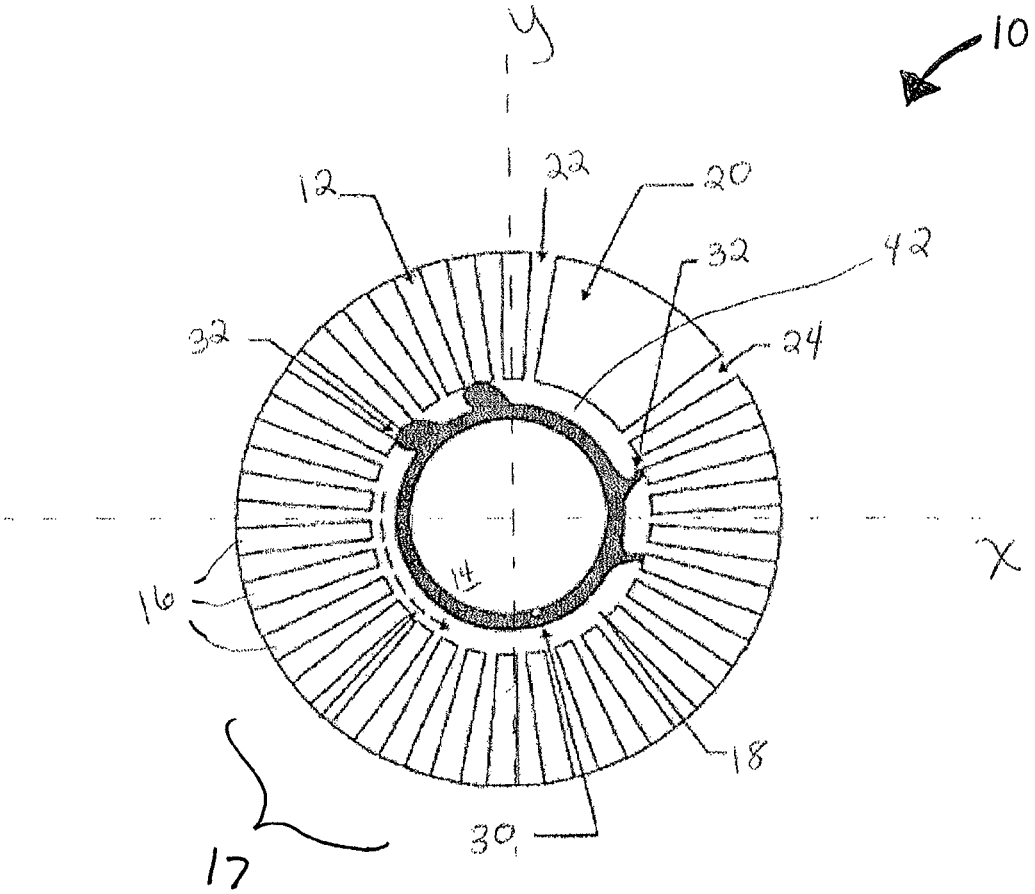
FIG. 1A (PRIOR ART)
FIG. 1A is a cross-sectional view of a prior art slow-wave-circuit and drift block assembly.

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. As will be appreciated, the specification and the drawings use the same reference numerals to refer to the same components that are present in multiple figures.

Various crossed-field amplifiers are disclosed herein. In general, CFAs include an input coupler for receiving an RF wave, an output coupler for transporting an amplified RF wave, an anode, and a cathode. In one embodiment, the geometry of the cathode and/or the anode reduces the velocity of the electrons as they travel near the anode drift block. In another embodiment, an abrupt geometric change to the cathode at the beginning or the end of the anode drift block can disperse the electrons, thereby increasing the rate of mixing and diffusion. By decreasing the velocity of the electrons and/or increasing the diffusion of the electrons, the peak amplitude of spurious emissions produced by a CFA can be reduced.

Figure 1B:
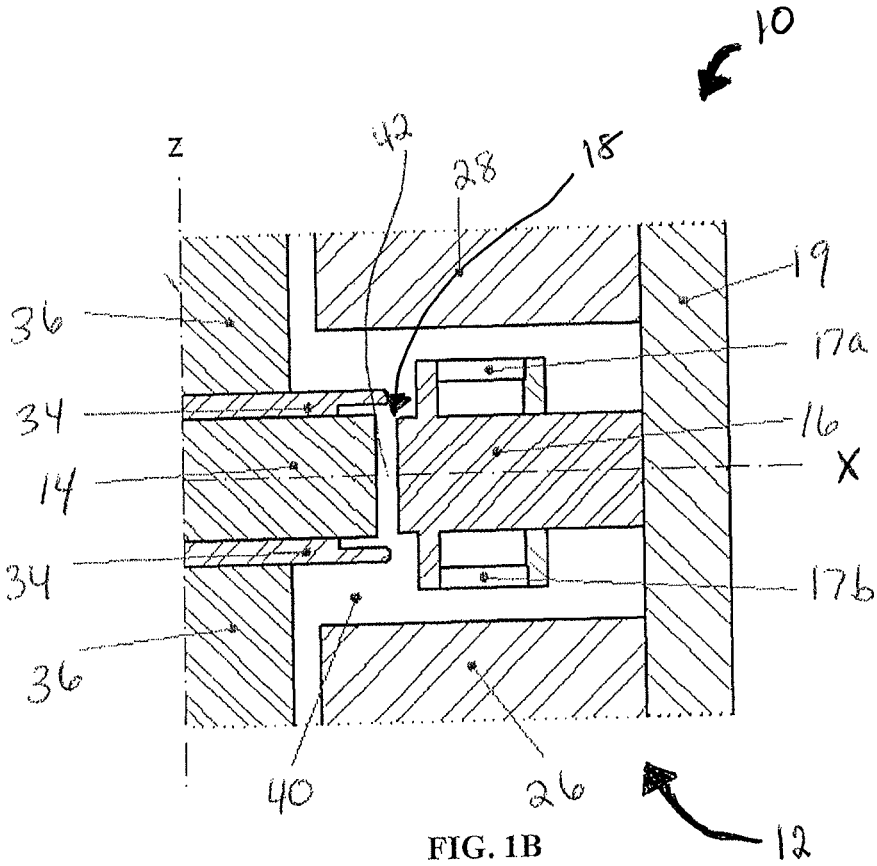
FIG. 1B (PRIOR ART)
FIG. 1B is a cross-sectional view of the slow-wave circuit and drift block assembly of FIG. 1A, taken along axis Z defining the longitudinal axis of the cathode and along axis X defining the radius of the cathode.

A crossed-field amplifier 10 as is known in the art is illustrated in FIGS. 1A and 1B. This device is illustrated because various features and advantages of the invention can be built into or added to this device. Accordingly, the features of this device are intended to be combined with the further features of the invention to create improved CFAs without limitation. In the illustrations, an X-Y-Z axis (FIG. 1B) system is provided. The Z axis generally extends along a longitudinal axis of symmetry of the generally cylindrical device, while the X and Y axes (FIG. 1A) are perpendicular to the Z axis. FIG. 1A provides a partial cross-sectional view taken in the X-Y plane at a particular point along the Z axis generally representing the center of the device (seen as the X axis in FIG. 1B, as the Y axis extends into the page). FIG. 1B shows a partial cross-section of the device taken in the X-Z plane, and illustrates one half of the device—in the figure, the half extending to the right of the Z axis.

Referring now to FIG. 1A, a cross-sectional view of the prior art crossed-field amplifier 10 is shown. This crossed-field amplifier 10 generally includes an anode 12 and a cathode 14. The anode 12 can have a substantially-annular shape and can comprise a plurality of vanes 16 that coaxially surround the cathode 14 and form the slow wave circuit 17. The cathode 14 can have a substantially cylindrical shape, and the cathode 14 can be positioned substantially at a center of the annular shape anode 12, as shown in FIG. 1A. The anode 12 and cathode 14 can be sized and spaced apart to form a gap 18 therebetween that electrons can travel across, as will be discussed in further detail. The anode 12 can further include an anode drift block 20 positioned between an input coupler 22 configured to receive an RF wave and an output coupler 24 configured to transmit an amplified RF wave. Magnetic poles 26, 28 can be disposed above and below the anode 12 and the cathode 14, as shown in FIG. 1B. More specifically, the magnet field can be applied in a direction Z, which is defined by the longitudinal axis of the cathode.

FIG. 1B provides a cross section of the CFA of FIG. 1A showing the geometry of the exemplary CFA in greater detail, including the spacing between the anode 12 and the cathode 14. The gap 18 is formed between the cathode 14 and the circuit vane 16, and a shank (shown as cathode support 36) can be secured to the cathode and the circuit vane to maintain this spatial relationship. FIG. 1B also shows an end hat 34 that couples the cathode 14 to a cathode support 36. With respect to the anode 12, the circuit vane 16 has a longitudinal axis that extends along axis X. Preferably a vacuum is applied within the space 40, although the space might also be pressurized with an inert or electrically stable gas. A first circuit advance 17*a* and a second circuit advance 17*b* provide a helical structure that connects one vane to the next as is known in slow wave circuits. An outer body 19 surrounds the anode 12, and can further include a water cooling jacket (not shown) for cooling the elements of the CFA.

Referring back to FIG. 1A, electrons 30 can be emitted from the cathode 14 as a result of primary (thermionic) emission, secondary emission, or both. The electrons 30 can travel across the gap 18 and toward the anode 12. Under the influence of the magnetic field applied in a perpendicular direction relative to the motion of the electrons 30, the electrons 30 are re-directed from moving directly toward the anode 12 to revolving around the cathode 14 in the direction shown by the dashed arrow. As the electrons 30 revolve around the cathode 14, the electrons can also form charge bunches 32, while some of the electrons 30 can be absorbed into the anode 12 and/or the cathode 14. Some of the electrons 30 will interact with an RF wave (not shown) travelling in the same direction and will transfer kinetic energy to the wave, causing amplification of the RF wave. The amplified RF wave can then propagate through the output coupler 24 of a wave guide assembly attached to an external load, while spent electrons 34 drift through a portion of the gap 18 referred to herein as a drift gap, or drift region. As shown in FIG. 1B, drift gap 42 is adjacent to, or next to, the anode drift block 20.

Figure 2:
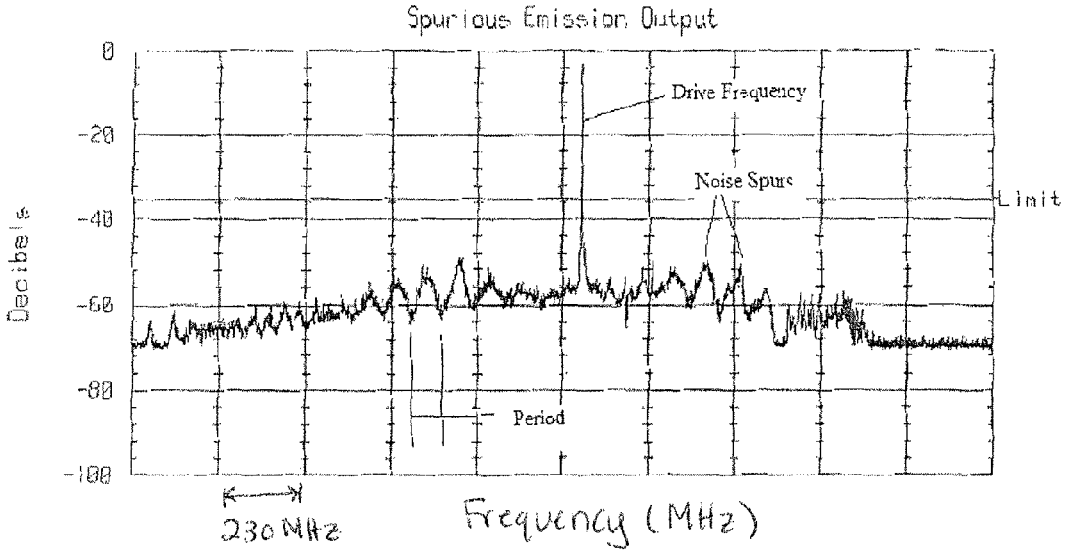
FIG. 2 is a spectrum of spurious emission output as a function of frequency from a prior art crossed-field amplifier.

As will be appreciated by those skilled in the art, electrons 30 travel through the drift gap 42 for a short period of time. As a result, the electrons 30 do not typically have enough time to diffuse and form a substantially uniform electric field prior to reaching the input coupler 22. As previously explained, these fluctuations in electron density can cause crossed-field amplifiers to produce spurious emissions, or spurious noise, consistent with the spectrum of spurious emissions output provided in FIG. 2. As shown in FIG. 2, the spurious emissions (i.e. noise spur) can occur at various frequencies and with some periodicity (i.e. labeled "period" along the frequency axis which is spaced in increments of 230 MHz), and the amplitude of the spurious emissions in decibels can also vary. It would be desirable to reduce or limit the spurious emissions to 30 dBc or less to decrease the impact of spurious emissions on the effectiveness of communication systems, including radars.

Without being bound to a particular theory, one way to reduce spent electron velocity in the drift space and decrease spurious emissions is to increase the distance between the anode drift block and the cathode. This reduces the dc electric field in the drift gap, $E_{dc}$, and so reduces the drift velocity, $v_d$, given by: $v_d = E_{dc}/B$; where B is the static magnetic field.

As an additional theory related to the periodicity of the spurious emissions, coherency of re-circulating space charge is known to affect spurious noise away from the carrier. In particular, data taken by A. MacMullen at NSWC and distributed as: "A Quick Look At Some May 99 CFA Data" indicates a periodicity in the spurious output of about 68 MHz. Since the hub spokes in the CFA rotate at a rate that is synchronous with the phase velocity of the RF circuit wave on the anode, it is reasonable to believe that frequencies supporting an integer number of wavelengths around the cathode will be regenerative and will cause an increase in the amplitude of spurious emissions at particular frequencies. This can be expressed mathematically for the $n^{th}$ resonance as: $\beta_n L=2\pi n$ where $\beta_n=\theta_n/P$ is the wave number with $\theta_n$ the phase shift per circuit section and P the circuit pitch. The parameter L is the total length or perimeter of the anode bore inner diameter (ID), including the drift region. Since β is linearly related to frequency, ω, over the operating band of the CFA, the resonant frequencies can be estimated.

By taking the difference between two adjacent resonances, the separation between resonances can be calculated as $\Delta f=1/mL=65$ [MHz]. By way of example, for the AEGIS CFA, m=1.125E−7 [s/m] and L=0.136 [m]. Note here that m is the reciprocal group velocity of the circuit. This periodicity, calculated from the cold circuit parameters, is close to the observed spurious output periodicity shown in FIG. 2.

A significant reduction in spoke coherency can be achieved by exploiting the natural turbulence in the electron hub as it passes through the drift region. Making the drift region physically longer has previously been used to achieve this goal, with somewhat limited success. However, the drift space can be made electronically longer without making the drift length longer. This is accomplished by increasing the anode-to-cathode spacing in the drift region. When this is done, the E/B drift velocity of the hub electrons is reduced in the drift region. This will increase the transit time for the drift space and allow for increased mixing of hub electrons prior to reentering the input section.

In light of theories of chaotic mixing, it is expected that increasing the anode-to-cathode spacing would significantly reduce the spoke coherency across the drift region. More specifically, two electrons that enter the drift region with nearly the same initial conditions will follow paths that diverge from each other at an exponential rate. If the initial, small separation between two electrons is $\Delta x_0$, then the separation at a later time t is approximately: $\Delta x \approx \exp(ht)\Delta x_0$; where h>0 is the Lyapunov exponent for the mixing process. If the anode-to-cathode spacing is increased by two times the nominal gap spacing in the interaction region, then the electron transit time will approximately double. This will cause an increase in separation by a multiplication factor exp(ht) over the base line separation assuming that the value of h remains fairly constant.

Consistent with these theories, the geometry of the anode and/or the cathode can be altered to achieve the desired reduction in drift velocity. In one embodiment, the radius of a cathode portion that is positioned across from the anode drift block, separated by the drift gap, can be reduced to achieve a larger spacing within the drift gap. This is shown, for example, in FIGS. 3A and 3B in which the cathode has a straight-cut portion. A person skilled in the art will appreciate that other changes in geometry can create larger spacing between the anode drift block and the cathode. By way of non-limiting examples, a straight-cut can be made on the edge of the anode adjacent to the drift gap without forming a cut portion on the cathode, or both the anode drift block and the cathode can have straight-cut portions.

Figure 3A:
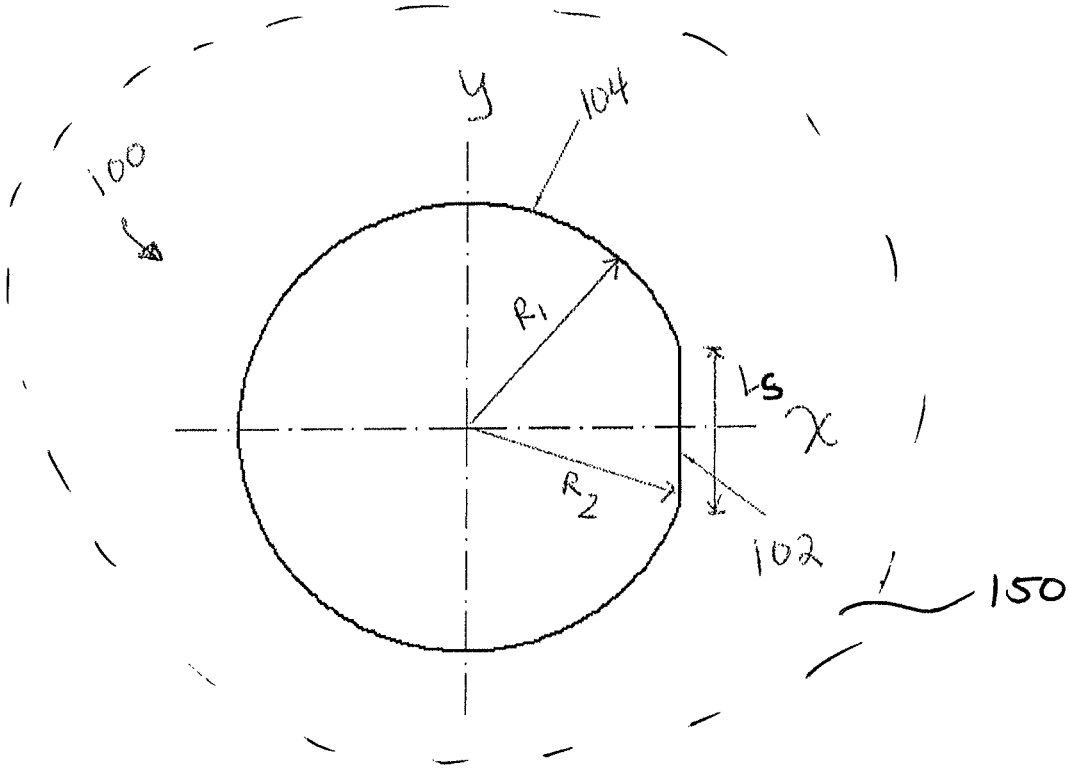
FIG. 3A is an end view of a cathode having a straight cut portion, according to one exemplary embodiment.
Figure 3B:
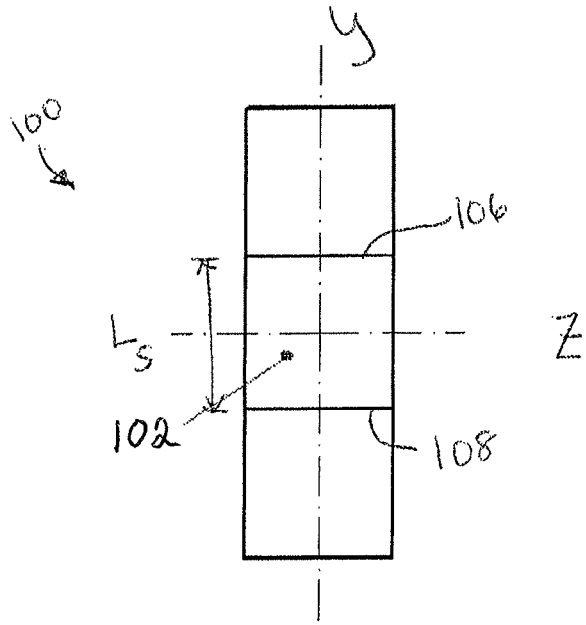
FIG. 3B is a side view of the cathode of FIG. 3A.

As previously explained, FIG. 3A illustrates a cross-section of a cathode having a straight-cut portion 102. FIG. 3B illustrates a side view of the cathode of FIG. 3A and shows a first edge 106 and a second edge 108 that form the straight-cut portion 102. Returning to FIG. 3A, the cathode 100 can have a first radius $R_1$, the cathode 100 can have a second radius $R_2$ that defines the straight-cut portion 103. The straight cut portion 102 is a substantially-planar surface, in contrast to the remaining surface of the cathode 104 that is curved. A person skilled in the art will appreciate that the surface of this portion of the cathode could also include a plurality of surface features, for example peaks and valleys, such that the drift gap thickness varies over the length of the cut-portion. As shown in FIG. 3B, a length $L_s$ of the straight-cut portion 102 can extend between about 30-90 degrees of the cathode. The straight-cut portion 102 can also occupy varying angles relative to the cross-section of the cathode 100, and this can range from about 30 to about 90 degrees. A person skilled in the art will also appreciate that the length of the straight-cut portion can correspond to a length of the anode drift block (not shown). Alternatively, the straight-cut portion can be longer or shorter than the anode drift block.

In another embodiment, the geometry of the cathode can be altered to both increase the diffusion of the electrons and decrease their velocity in the drift gap. This is true in the embodiment shown in FIGS. 4A and 4B for example, in which the reduction in the radius of the cathode is made abruptly, with little or no taper. A person skilled in the art will appreciate that other changes in geometry can increase the diffusion of the electrons and decrease electron velocities in the drift gap, including by way of non-limiting example, abruptly reducing the radius of the cathode in conjunction with the thickness of the anode drift block, or abruptly reducing the thickness of the anode drift block without reducing the radius of the cathode.

Referring back to FIG. 4A, a cross-section of a cathode 204 can also include a stepped-cut portion 202. The side view of the CFA shown in FIG. 4B illustrates first step 206, a second step 208, and the reduced-radius cathode portion 202, also referred to as the stepped-cut portion. As shown, the reduced-radius cathode portion 202 has a curved surface that approximates a circle having a radius $R_4$, while the cathode 204 has a larger radius $R_3$. A horizontal length $L_c$ of the reduced-radius cathode portion 202 can be substantially equal to a length of the anode drift block (not shown), or the length of the reduced-radius cathode portion can be longer or shorter than the length of the anode drift block. Additionally, the reduced-radius cathode portion can occupy various angles relative to the cross-section of the cathode 204, and this can range from about 30 to about 90 degrees. The first step 206 and the second step 208 can also be oriented along an axis that defines a radius of the cathode 204. A person skilled in the art will appreciate that the first step and/or the second step can be oriented at different angles relative to the radii of the cathode to provide different rates of electron diffusion within the drift gap.

Figure 5:
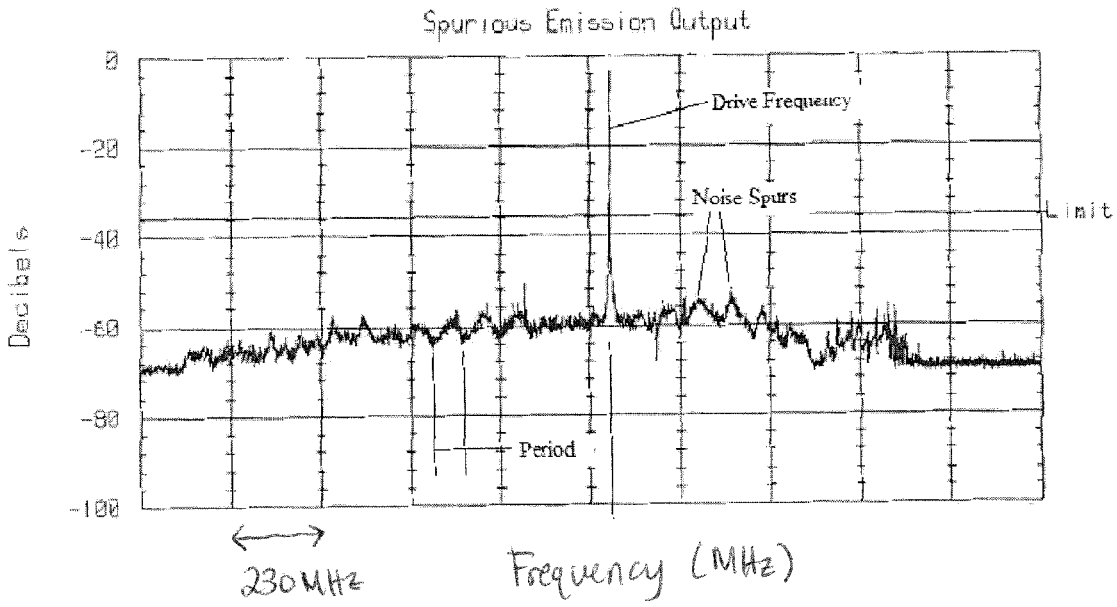
FIG. 5 is a spectrum of spurious emission output as a function of frequency from the crossed-field amplifier of FIGS. 4A and 4B.

Experimental data confirms that the changes in geometry to the cathode and/or the anode drift block can reduce spurious emissions. For example, FIG. 5 shows the broadband spectrum from a CFA body that produced the emission spectrum of FIG. 2, but rebuilt to include a stepped-cut portion. In this embodiment, the cut depth was about 82.4% of the size of the anode-to-cathode spacing. As can be seen from FIG. 5, the amplitude of the broadband noise in decibels is noticeably reduced.

In both FIG. 2 and FIG. 5, the highest amplitude spurious noise occurs at several drive frequencies near the high end of the operating band. In the prior art CFA of FIG. 2, the highest amplitude spurious noise emission (i.e. noise spurs) was −31 dBc (decibels relative to the carrier). When the CFA has the stepped-cut portion 202 that is about 82.4% of the size of the anode-to-cathode spacing, the highest amplitude spurious noise emission (i.e. noise spurs) is −45 dBc as shown in FIG. 6. The average of the worst case measurements was 40.8 dBc for the baseline, constant cathode radius CFA and −47.4 dBc with the stepped-cut 202. Thus, for this particular embodiment, the average peak spurious was reduced by about 6.5 dB for drive frequencies near the high end of the operating band.

FIG. 6 is a table of experimental results for exemplary CFAs having various sized stepped-cut cathode radii. It includes a summary of spurious emission data for smaller sized cuts (i.e. cut depth), of 29.4%, and 41.2% of the anode-to-cathode spacing. The highest amplitude (worst case) spurious emission and the average worst spurious emission are also provided to illustrate the relationship between cathode radius reduction, spurious emission, and CFA efficiency at center frequency. As shown, compared to the baseline CFA having a constant radius cathode, the efficiency penalty is about 3 percentage points. For these smaller stepped-cut depths, the improvement in average peak spurious amplitude as compared to the baseline CFA is about 5 dBc. Thus, having a larger cut-depth in the cathode can further reduce the amplitude of spurious emissions compared to smaller cut-depths.

As also shown in FIG. 6, while the CFA generated adequate output power using this cathode cut, there was an efficiency penalty of about 6 percentage points. Without being bound to a particular theory, this may have resulted from loss of reentrant charge (some electron scraping) caused by the cutout in the cathode. In particular, electrons may have been absorbed into the stepped-cut cathode portion. Since the rotating hub electrons carry kinetic energy that is useful for maintaining synchronism with the RF wave, the collection of hub electrons in the drift region can lead to the reduction in CFA efficiency. Despite the minor loss in CFA efficiency, smaller reductions in cathode geometry are still desirable for reducing spurious emissions compared to prior art CFAs.

Figure 4A:
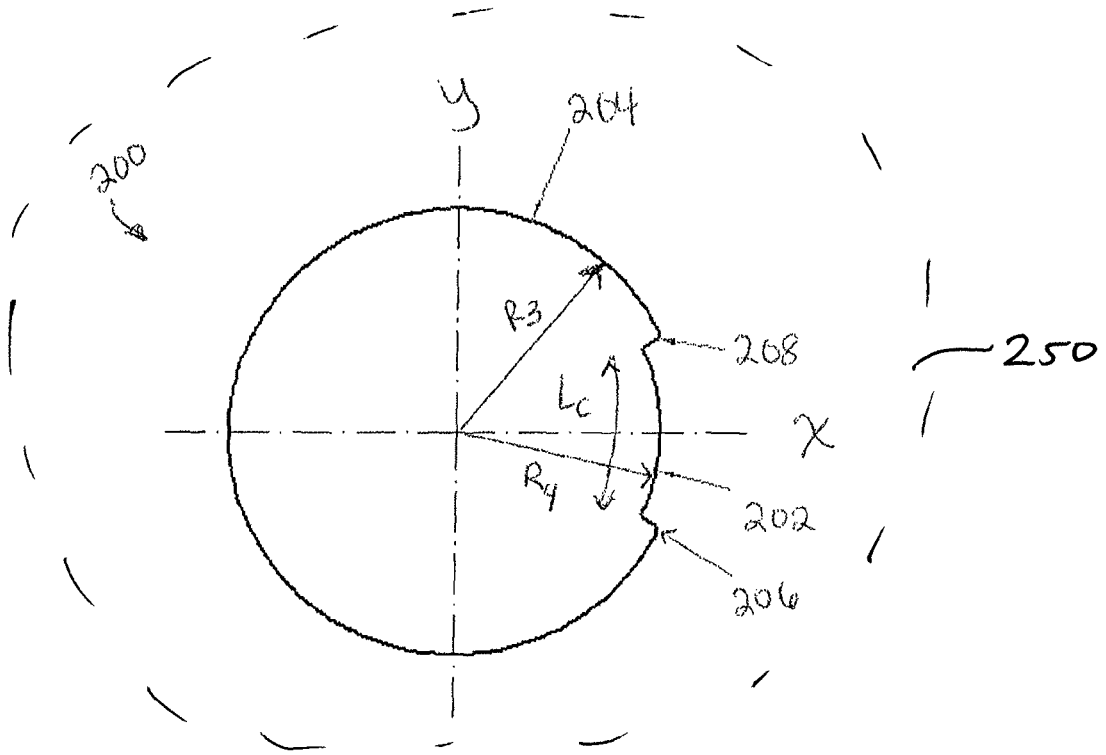
FIG. 4A is an end view of a cathode having a reduced radius portion, according to another exemplary embodiment.
Figure 4B:
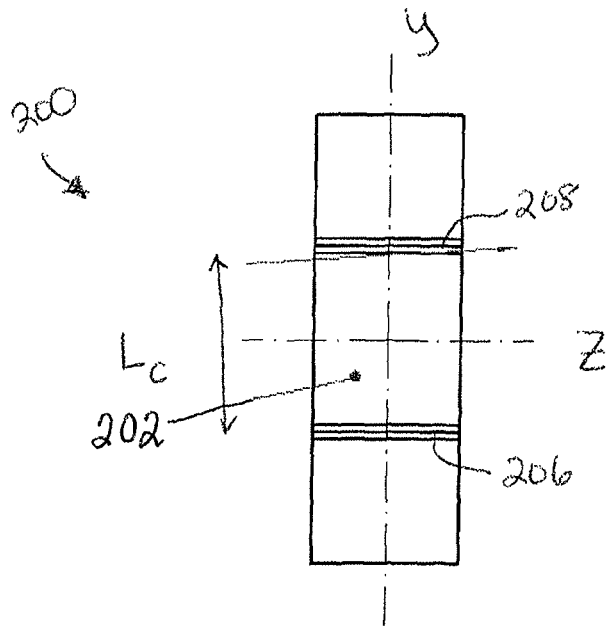
FIG. 4B is a side view of the cathode of FIG. 4A.

One skilled in the art will appreciate further features and advantages of the invention based on the above-described embodiments, such as body 150 shown in FIG. 3A for cooling and body 250 shown in FIG. 4A for cooling. Accordingly, the invention is not to be limited by what has been particularly shown and described, except as indicated by the appended claims. All publications and references cited herein are expressly incorporated herein by reference in their entirety.

What is claimed is:

1. A crossed-field amplifier comprising:

an input coupler for receiving an RF wave;

an output coupler for transporting an amplified RF wave;

a cathode having a substantially-cylindrical shape;

an anode comprising an anode drift block positioned between the input coupler and the output coupler;

wherein the cathode has a first section having a first radius and a second section having a second radius that is greater than the first radius, the first section of the cathode being adjacent to the anode drift block;

wherein the cathode radii consist of the first radius, a first step to the second radius, the second radius, and a second step back to the first radius;

wherein the radii of the first and second sections are selected such that electrons are dispersed as they move in a space adjacent to the cathode and the anode drift block;

wherein the anode drift block extends in a range of around 30-90 degrees.

2. The device of claim 1, wherein a magnetic field is oriented perpendicular to the first and second radii of the substantially-cylindrical shaped cathode.

3. The device of claim 1, wherein the first section of the substantially-cylindrical shaped cathode extends in a range of around about 30 to 90 degrees.

4. The device of claim 1, wherein the first section of the cathode adjacent to the anode drift block has the first radius that is substantially constant between the first step and the second step.

5. The device of claim 1, further comprising a body disposed around the anode for cooling.

6. A crossed-field amplifier comprising:

an input coupler for receiving an RF wave;

an output coupler for transporting an amplified RF wave;

a cathode having a substantially-cylindrical shape;

an anode comprising an anode drift block positioned between the input coupler and the output coupler;

wherein a section of the cathode adjacent to the anode drift block has a substantially planar surface such that electrons are dispersed as they move in a space adjacent to the cathode and the anode drift block, the section of the cathode having the substantially planar surface extending in a range of around 30 to 90 degrees.

7. The device of claim 6, further comprising a body extending around an outer surface of the anode for cooling the amplifier.

8. The device of claim 6, wherein the anode drift block extends in a range of around 30-90 degrees.

9. The device of claim 6, wherein a length of the section of the cathode adjacent to the anode drift block is substantially equal to a length of the anode drift block.

* * * * *